United States Patent [19]

Germann

[11] Patent Number: 4,509,424

[45] Date of Patent: Apr. 9, 1985

[54] CONVERTIBLE, MULTICOLOR, ROTARY PRINTING PRESS

[75] Inventor: Albrecht J. Germann, Würzburg, Fed. Rep. of Germany

[73] Assignee: De la Rue Giori S.A., Switzerland

[21] Appl. No.: 482,234

[22] Filed: Apr. 5, 1983

[30] Foreign Application Priority Data

Apr. 22, 1982 [CH] Switzerland ..... 2445/82

[51] Int. Cl.[3] ..... B41F 11/02

[52] U.S. Cl. ..... 101/177; 101/DIG. 28; 101/153

[58] Field of Search ..... 101/175, DIG. 28; 101/176, 177, 183, 184, 185, 152, 153, 154, 174

[56] References Cited

U.S. PATENT DOCUMENTS

| | | | |
|---|---|---|---|
| 2,024,813 | 12/1935 | Barber | 101/DIG. 28 |
| 2,270,272 | 1/1942 | Davidson | 101/DIG. 28 |
| 2,270,273 | 1/1942 | Davidson | 101/DIG. 28 |
| 2,659,305 | 11/1953 | Giori | 101/155 |
| 3,172,359 | 3/1965 | Dickerson | 101/DIG. 28 |
| 3,426,679 | 2/1969 | Rhines | 101/175 |
| 4,056,056 | 11/1977 | Giori | 101/175 |
| 4,441,423 | 4/1984 | Germann | 101/175 |

FOREIGN PATENT DOCUMENTS

| | | | |
|---|---|---|---|
| 803546 | 5/1957 | United Kingdom | 101/175 |

OTHER PUBLICATIONS

Package Printing, Sep. 1978, p. 14.

*Primary Examiner*—Edgar S. Burr
*Assistant Examiner*—M. J. Hirabayashi
*Attorney, Agent, or Firm*—Kane, Dalsimer, Kane, Sullivan and Kurucz

[57] ABSTRACT

A convertible, multicolor, printing press for printing the safety background of banknotes or the like comprises, in one configuration, an impression cylinder, a second blanket cylinder which engages the impression cylinder, a first plate cylinder which engages the second blanket cylinder and also engages a first blanket cylinder which first blanket cylinder is spaced from the impression cylinder, and several sectioned inking rollers which engage the first blanket cylinder and which are each inked by inking devices of different colors. The printing press is converted to a second configuration by exchanging the sectioned inking rollers for second plate cylinders, separating the first plate and second blanket cylinders from engagement with the first blanket (11–14) and impression cylinders respectively, and moving the impression cylinder to directly engage the first blanket cylinder. In the one configuration, a juxtaposed color image may be printed and in the second configuration, a superposed color image may be printed.

3 Claims, 2 Drawing Figures

CONVERTIBLE, MULTICOLOR, ROTARY PRINTING PRESS

BACKGROUND OF THE INVENTION

1. Field of the Invention

The present invention relates to a rotary sheet- or web-fed printing machine for making multicolor prints, notably for printing safety backgrounds of paper currency, for instance banknotes, of the type comprising essentially an impression cylinder around which the paper to be printed is caused to pass, a first blanket cylinder, at least two plate cylinders each inked with a different color by a separate inking device and cooperating with said blanket cylinder for applying a multicolor image to this blanket cylinder, a group of two cylinders comprising a plate cylinder to which a typographic plate representing the complete design to be printed is affixed, and a second blanket cylinder contacting said plate cylinder.

2. The Prior Art

A machine of this character has been proposed for printing an image with juxtaposed colors by means of a single printing plate and a plurality of inking rollers, this method being usually referred to as the "Orlof" method.

In this method, a cylinder carrying a single typographic plate representing the complete design to be printed is used. This plate is inked by a collector cylinder inked in turn by sectioned inking rollers each adapted to transfer the color received from its particular inking device. With this method a multicolor image characterized by a perfect register between the different colors of design is obtained, a result unattainable with any other printing method.

On the other hand, the superposed color and design printing is also known (indirect typography or offset) which is likewise frequently used for printing safety backgrounds of paper currency. In this method, the complete design is composed of partial designs of different colors carried by printing plates wrapped around plate cylinders to permit the superposition of perfectly registering designs and colors. The number of printing plates and consequently of plate cylinders corresponds to the number of different colors and designs constituting the multicolor image.

In the present state of the art, machines utilizing separately one or the other of the above-mentioned methods have been developed.

SUMMARY OF THE INVENTION

It is the primary object of the present invention to provide a single and same machine capable of operating according to the two above-described methods and changing from one method to the other in the simplest possible manner.

For this purpose, the machine of the present invention is characterized inter alia not only by the fact that it is capable of implementing two totally different methods but also by the specific economical advantage of enabling the operator to choose the method without the necessity of having two separate machines at its disposal. The change from one method to the other, in a machine designed for operating according to both methods, is particularly simple.

Reference will now be made to the attached drawings in order to afford a clearer understanding of the manner in which the passage from one method to the other takes place.

THE DRAWINGS

FIG. 1 shows diagrammatically the positions of the component elements of the machine when operating according to the "Orlof" method, and FIG. 2 is a similar view showing the positions of the component elements of the same machine when operating according to the indirect typographic or offset method.

However, it is pointed out preliminarily that the two Figures differ only by the relative arrangement of certain component elements of the machine; therefore these elements are designated by the same reference numerals in both Figures.

DESCRIPTION OF THE PREFERRED EMBODIMENT

Figure 1:
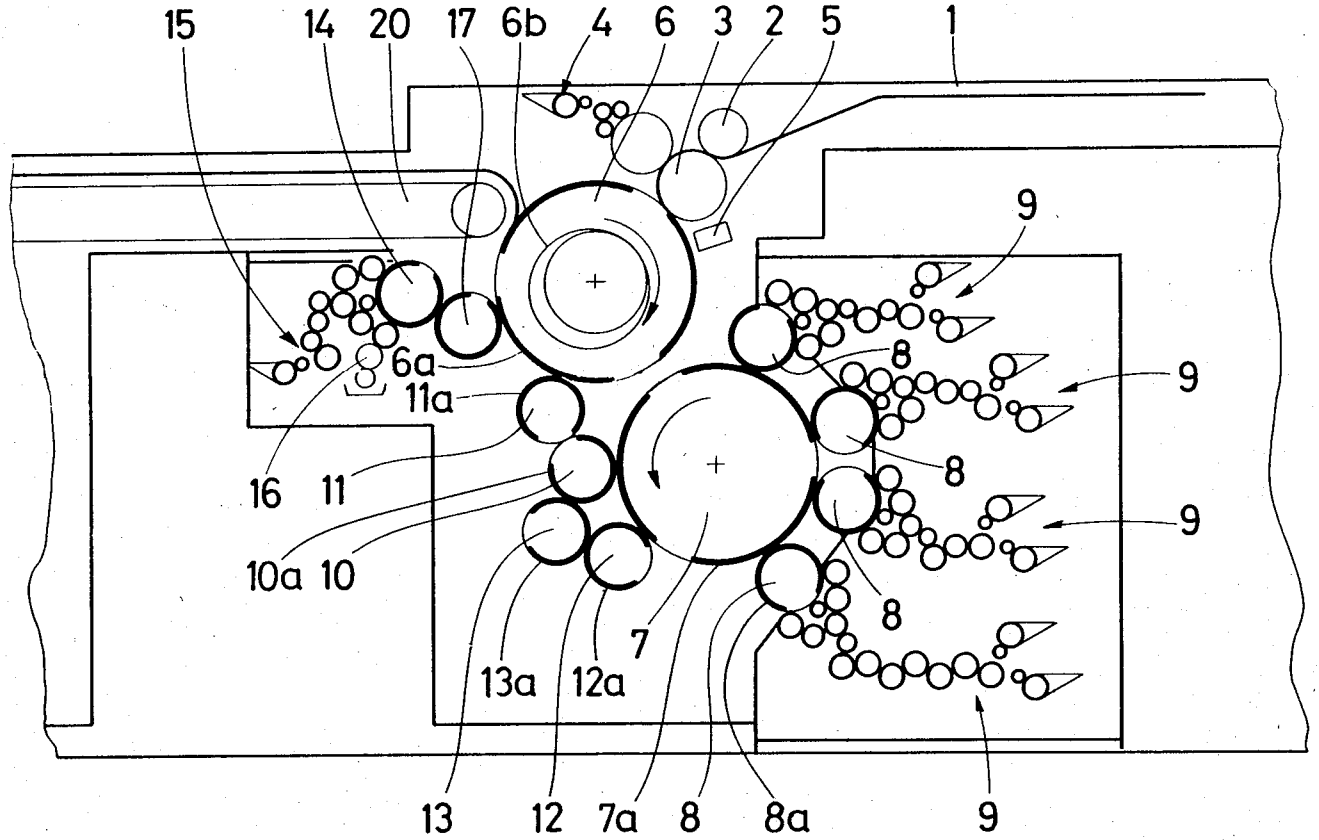

The machine illustrated in the drawings is a sheet-fed printing machine comprising a sheet feed or input device 1 provided with a stop drum 2, a transfer cylinder 3 and possibly a device 4 for numbering the sheet edges, and a device 5 for dusting off and demagnetizing the paper sheets. The individual sheets are transferred to an impression or counter-pressure cylinder 6 rotating in the direction of the arrow, and after printing each sheet is transferred by an endless chain and gripping device 20 to an output pile or to another machine for printing the other side.

The paper sheet passing around the impression cylinder 6 can be printed, according to the present invention, either according to the "Orlof" method (FIG. 1) or according to the indirect typographic or offset method (FIG. 2), notably for printing a safety background on one side of the paper sheet. A blanket cylinder 7 is provided for this purpose and used in both cases but in different ways.

Figure 2:
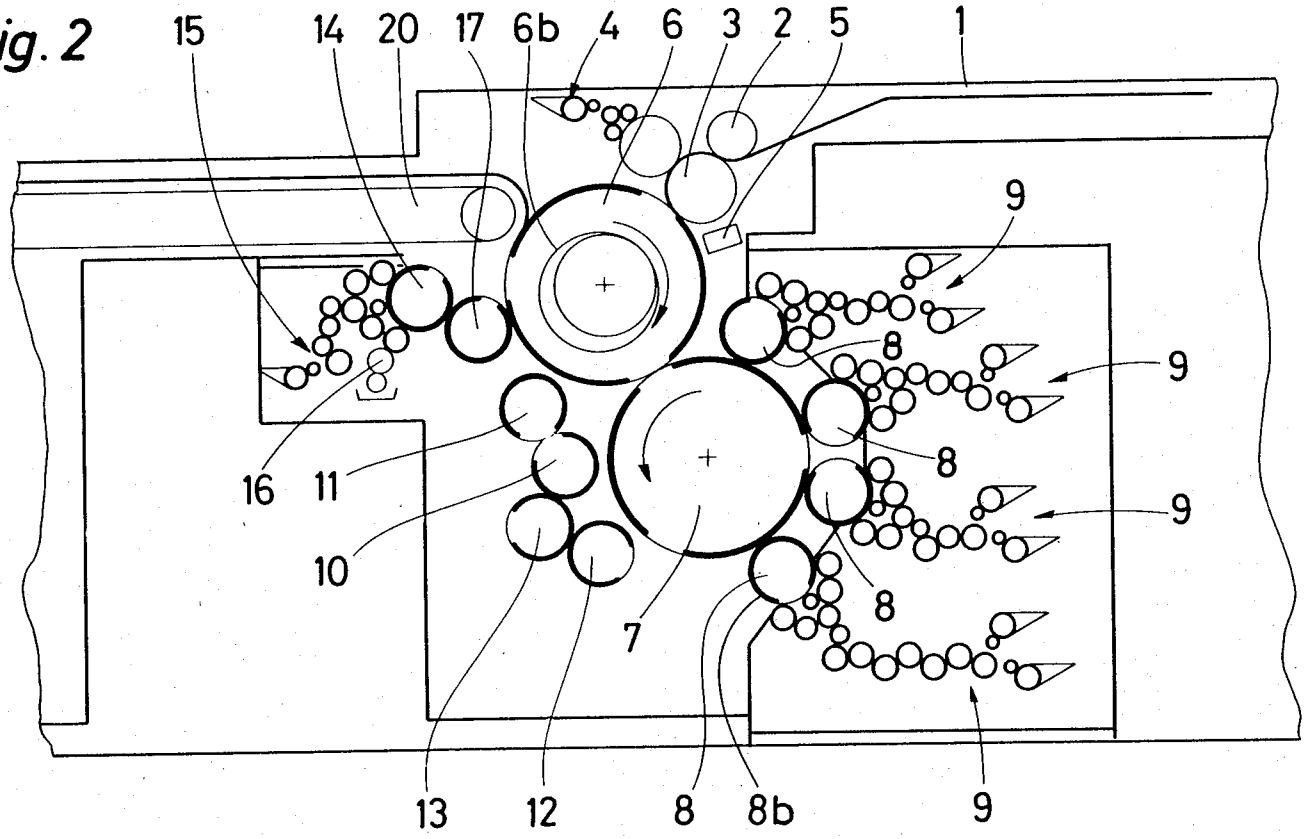

When the machine is operated according to the "Orlof" method, the impression cylinder 6 is moved away from blanket cylinder 7 (FIG. 1). In actual practice, this movement is produced very simply by means of an eccentric **6*b* on which the hollow impression cylinder 6 is mounted. This eccentric mounting is well known per se and permits of adjusting the pressure and separating the two cylinders when the machine is inoperative. The assembly is such that when the eccentric is rotated the cylinder axis is shifted. Consequently, for this separation the machine utilizes means already known from existing machines. When the two cylinders are spaced apart, the gap left between them is extremely short, for example one mm or a few mm, the distance shown in FIG. 1** being grossly exaggerated for explanatory purposes.

In the example shown in FIG. 1 the blanket cylinder 7 cooperates with four sectioned inking rollers 8 provided with relief portions **8*a* cut out according to the contours of the areas to be printed in the relevant colors, which are each inked with their specific colors by means of a double inking device 9. These inking rollers 8 with their relief portions 8*a* are made preferably from hard material so that they will not undergo a distortion even if the relief is extremely fine, so that a safety background consisting of very fine lines can be obtained in the final print. The areas bearing the four colors are transferred to the blanket cylinder 7 operating as a collector cylinder assembling these areas and transferring them onto a single plate cylinder 10 provided with the printing plate 10***a;* this printing plate 10*a* is a typographic plate representing the complete design to be printed in four colors. The complete image inked with four different colors is then transferred onto a blanket cylinder 11 having a smaller diameter than blanket cylinder 7 and cooperating with the impression cylinder 6 for applying the complete image onto the paper surface.

The machine further comprises an image transmitting cylinder 12 and a rubber inking cylinder 13 transferring in perfect register the same image of the colored areas of blanket cylinder 7 onto the plate cylinder 10, thus permitting of reinforcing the inking of printing plate 10*a* in the desired colors and consequently of better covering these areas with the desired ink. In fact, considering the direction of rotation of blanket cylinder 7, most of the ink is transferred directly onto the printing plate 10*a* of plate cylinder 10, the residual ink being transferred in perfect register by the rubber inking cylinder 13 via the transmission cylinder 12.

In the example described herein, the printing according to the "Orlof" method is followed by a wet offset printing accomplished in a single pass when the paper is passing around the impressing cylinder 6, which is applicable more particularly for printing the main monochrome design of the paper currency. The wet off-set system utilizes an intaglio plate cylinder 14 provided with an inking device 15 and a wetting device 16 known per se, this intaglio plate cylinder 14 cooperating with a blanket cylinder 17 transferring the image to the paper surface. Therefore, in the case contemplated, a complete printing is obtained on one side of a banknote, for example the four-color safety background, by printing according to the "Orlof" method, the monochrome main design being obtained by printing according to the wet offset method.

In the example illustrated the ratio of the diameters of cylinders 8, 10, 11, 12, 13, 14 and 17, on the one hand, to the diameters of cylinders 6 and 7, on the other hand, is 1:3; thus, the periphery of cylinders 6 and 7 corresponds to three sheets of paper, and the blanket cylinder 7 as well as the impression cylinder 6 carry each three blankets 7*a,* respectively 6*a,* while the blanket cylinder 11, transmission cylinder 12 and rubber inking cylinder 13 carry only one blanket 11*a,* 12*a* and 13*a,* respectively.

In a modified form of embodiment it is also possible to exchange the positions of plate cylinder 10 and blanket cylinder 11. In this case the printing is made directly by plate cylinder 10, and plate 10*a* is inked by blanket cylinder 11 contacting blanket cylinder 7 and rubber inking cylinder 13.

When the same machine is used for printing sheets or webs according to the indirect typographic or offset method (FIG. 2), it is only necessary to replace the inking rollers 8, 8*a* with plate cylinders 8, 8*b,* provided with printing plates 8*b,* to separate the blanket cylinder 11 from the impression cylinder 6, to separate the plate cylinder 10 and the image transmitting cylinder 12 from the blanket cylinder 7 and to move the impression cylinder 6 towards blanket cylinder 7 until they engage each other. The printing plates 8*b* are typographic plates like those used in the dry offset method, and they represent the partial designs inked, as in the preceding case, by inking devices 9. These partial designs printed in different colors are assembled on the blanket cylinder 7 operating in this case as a collector cylinder for the partial designs constituting the multicolor image. Thus, a dry offset four-color print is obtained during the passage of the paper sheet between the impression cylinder 6 and the blanket cylinder 7. This multicolor offset print may also be completed by a monochrome wet offset printing by means of the above-described intaglio plate cylinder 14 and blanket cylinder 17.

The relative spacing between the various cylinders, namely between impression cylinder 6 and blanket cylinder 7, between blanket cylinder 11 and impression cylinder 6, between cylinders 10, 12 and blanket cylinder 7, as well as the necessary movements of the other rollers and cylinders with respect to the shifted cylinders, are adjusted in a manner known per se, notably by mounting all the rollers and cylinders on eccentrics, as already explained with reference to the impression cylinder 8. These relative spacings correspond to very short distances, of the order of a few millimeters.

During the offset printing, the inoperative plate cylinder 10, blanket cylinder 11, image transmitting cylinder 12 and rubber inking cylinder 13 are not driven, their driving system remaining disconnected from the machine drive.

Of course, the wet offset system mentioned within the scope of the present invention may be dispensed with. However, this system is advantageous in that it permits of obtaining a complete printing on one side of a paper currency.

Moreover, the inking rollers 8, 8*a* adapted to ink the blanket cylinder 7 having a collecting function may be replaced by sectioned plates affixed to a cylinder. In this case, for changing from one printing method to the other it is only necessary to change the plates carried by cylinders 8 contacting the blanket cylinders 7, but without changing the cylinders proper.

What is claimed as new is:

1. A convertible multicolor printing machine comprising, in one configuration:

a. a blanket cylinder;

b. an impression cylinder spaced away from said blanket cylinder for holding sheets during printing;

c. a first plate cylinder in contact with said blanket cylinder and disposed between said impression and blanket cylinders for transferring a multicolored design to said sheets;

d. a plurality of inking rollers for transferring different colored contours of ink to said blanket cylinder; and e. means for converting said printing machine into a second configuration, said means comprising means for exchanging said plurality of inking rollers for a plurality of second printing plates which second printing plates transfer multicolored designs to said blanket cylinder, means for moving said impression cylinder from a first position, in one configuration, in which the impression cylinder is spaced away from said blanket cylinder to a second position, in the second configuration, in which said impression cylinder contacts said blanket cylinder, means for moving said first plate cylinder from a first position, in one configuration, in which said first plate cylinder is disposed between said impression and blanket cylinders and in contact with said blanket cylinder to a second position, in the second configuration, in which said first plate cylinder is spaced away from said blanket and impression cylinders;

whereby sheets may be printed by moving said impression cylinder and said first plate cylinder to said respective first positions in which ink is transferred from said inking rollers to said blanket cylinder which ink the first plate cylinder, said first plate cylinder transferring said design to said sheets; and whereby sheets may be printed by moving said impression and said first plate cylinders to said respective second positions and exchanging said plurality of inking rollers for a plurality of second printing plates whereby multicolored designs are transferred from said second printing plates to said blanket cylinder and from said blanket cylinder directly to said sheets in said impression cylinder.

2. The machine of claim 1 further comprising a plurality of ink sources which provide ink to said inking or said second printing plates.

3. The machine of claim 1 further comprising an intaglio plate cylinder for superimposing a main design on said printed sheets.

* * * * *